United States Patent [19]

Orain

[11] 4,078,414

[45] Mar. 14, 1978

[54] APPARATUS FOR COLD FORMING METAL PARTS

[75] Inventor: Michel Orain, Conflans-Saint-Honorine, France

[73] Assignee: Societe Anonyme Dite: Glaenzer Spicer, Poissy, France

[21] Appl. No.: 782,372

[22] Filed: Mar. 29, 1977

[30] Foreign Application Priority Data

Apr. 6, 1976 France ..... 76 09999

[51] Int. Cl.[2] ..... B21D 22/00

[52] U.S. Cl. ..... 72/354; 72/357

[58] Field of Search ..... 72/353, 354, 357, 358, 72/360, 377

[56] References Cited

U.S. PATENT DOCUMENTS

| | | | |
|---|---|---|---|
| 1,946,117 | 2/1934 | Sparks | 72/354 |
| 2,663,205 | 12/1953 | Allen | 72/354 |
| 2,744,426 | 5/1956 | Lyon | 72/354 |
| 3,583,198 | 6/1971 | Drallmeier | 72/358 |

*Primary Examiner*—Leon Gilden

*Attorney, Agent, or Firm*—Diller, Brown, Ramik & Wight

[57] ABSTRACT

Apparatus is described for cold forming cylindrical metal blanks into parts having a central body and radial extensions, such as universal joint spiders and constant velocity universal joint tripod members. Die sectors of shortened axial height in their radial forming and extrusion zone are mounted for quick fastening and release, for example by dovetail connections to die carriers which are in turn mounted on rams displaceable along inclined converging slideways. Guide bushes are provided at the entrance to the through cavity corresponding to the central body and guide a cylindrical blank along the axes of coaxial punches fixed respectively to the plunger and column on the table for restraining plastic flow of blank metal towards the central cavity and then to the radial cavities.

4 Claims, 6 Drawing Figures

14
14
16
16
23
29
31
45
30
34
35
10
33
20
21
1
22
26
27
28
25
30
29
32
31
25
1
36
36
27
35
34
28
25
29
24
17
31

APPARATUS FOR COLD FORMING METAL PARTS

The present invention relates to apparatus for cold forming metal parts.

The invention relates more particularly to tool setups for cold forming metal parts having a central body and portions or arms extending substantially radially with respect to the central body, starting with metal billets or blanks which are cylindrical, e.g. cylinders of circular cross section, the resulting part may be a "spider" or cross member with four arms for a cardan universal joint or a so-called "tripod" member of a constant velocity universal joint.

Such a tool setup is disclosed in my U.S. Pat. No. 3,908,403, issued on Sept. 30, 1975, and essentially comprises a plural sector die arranged so that a chamber is defined when die sectors are brought together whose shape corresponds to the part to be formed. The chamber therefore comprises a central portion corresponding to the central body of the part and radiating portions corresponding to the radially extending portions or arms thereof. The die sectors are, in addition, of such configuration that when they are brought together, two coaxial openings one at each end of the central through cavity of the die permit the insertion of the starting billet or blank and the displacement of punches which compress the billet so as to fill entirely the internal chamber for forming the desired part. Each arm of the part results from a lateral extrusion of the billet metal through the die orifice of the corresponding portion of the cavity at the entrance to the central portion.

In this tool setup, in order to assure proper guiding of the flow of billet metal along the axes of the punches, there were provided adjacent die sectors defining axially extending cavities to each side of the central cavity adapted to form the central body of the part which necessarily augments the minimum height of the die sectors and therefore their cost; further, the die sectors are fixed on rams or slide members by screws which requires them to be taken apart when die sectors are to be replaced and accordingly increases maintenance time before the tool setup can be put back into service.

Now the efficiency of radial extrusion depends mainly on the cost of the die and the speed with which they may be replaced, because in assembly line production they wear and break rather quickly and their frequent replacement stops the cold forming machine during rather long periods of time owing to delicate adjustments which call for the skills of a specialized technician.

An object of the present invention is therefore the provision of an apparatus for cold forming of the foregoing type which is designed so that it uses small-sized easily dismountable die sectors permitting quick and inexpensive replacement.

In accordance with the invention apparatus for cold forming metal parts having a central body and radial extension from a cylindrical billet or blank is provided, essentially comprising a die including a plurality of die sectors arranged to form when brought together a chamber of shape corresponding to the part to be formed, means for bringing the die sectors together, and punch members provided for symmetrically penetrating into a central through cavity corresponding to the central body of the part to be formed, the punches serving to drive billet or blank metal from the central cavity towards transverse radial cavities of shape corresponding to the radial extensions to be formed, characterized in that the die sectors having shortened height in the radial forming and extrusion zone, die sector carriers, quick fastening and release means for fastening the die sectors on the die sector carriers, guide bushes disposed along the axis of the punches at the entrance to the central cavity of the die and adapted to retain radially the compressed billet metal and to channel its plastic flow towards the central cavity, and means for forcefully bearing the guide bushes against the die sectors when the die sectors are brought together.

The invention will now be described in greater detail having reference to a particular embodiment which is given merely by way of non-limiting example and illustrated in the accompanying drawings, in which.

Figure 1:
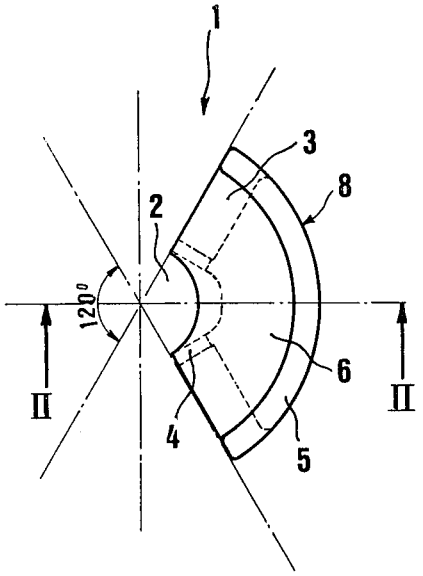
FIG. 1 is a plan view of a first type of die sector which is delimited radially by the axes of radial cavities.
Figure 2:
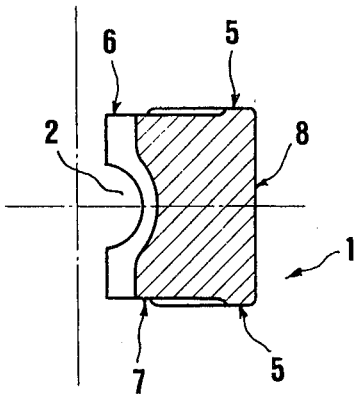
FIG. 2 is a cross-sectional view taken on line II—II of the die sector in figure 1.
Figure 3:
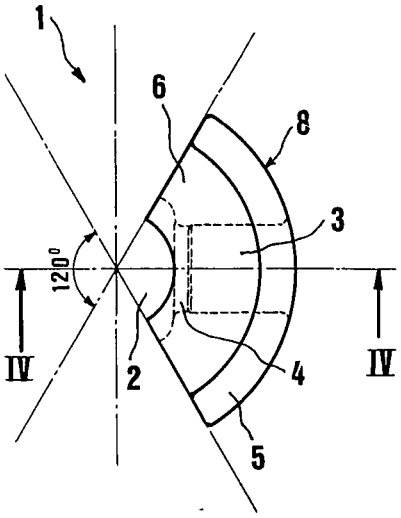
FIG. 3 is a view similar to that of FIG. 1 for a second type of die sector which is delimited radially in between adjacent radial cavities.
Figure 4:
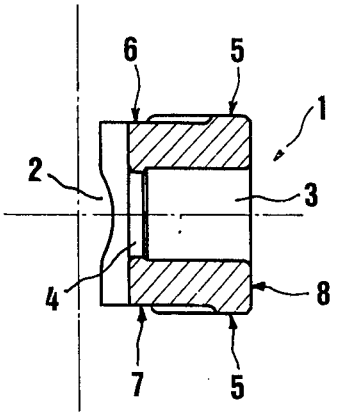
FIG. 4 is a cross-sectional view taken on line IV—IV of the die sector in FIG. 3.

FIGS. 1-4 show, by way of example, die sectors 1 adapted for a cold forming apparatus according to the invention. The complete die comprises three identical die sectors which, when brought together, define a central cavity 2 and three radial cavities 3 communicating with the central cavity 2 through narrowed passageways 4 which form die throats; each radial cavity may formed either half in each of two adjacent die sectors, as illustrated in FIGS. 1 and 2, or entirely in the same die sector (FIGS. 3 and 4).

In the illustrated embodiment of the invention, the die is formed of three adjacent die sectors defining an internal chamber of configuration corresponding to the part to be cold formed by extrusion, a tripod member of a universal joint in the present circumstances, however, the die may, of course, be provided with any number of die sectors for cold forming parts having a corresponding number of radial extensions from a central body.

Rear or outer bearing surface 8 of each die sector 1 is part cylindrical so that the die, formed by the die sectors 1 brought together, is in turn cylindrical, although it is obvious that the rear or outer bearing surfaces 8 may be planar.

The small size of the die sectors will be noted, they are of shortened axial height in the radial forming and extrusion zone 2. Shoulders 5 are formed on the parallel, upper and lower, sector-shaped surfaces 6 and 7, the shoulders forming annular retaining flanges bounding the upper and lower surfaces at their interface with the part-cylindrical outer bearing surface 8. The flanges 5 constitute quick die sector fastening means as will be understood below.

Figure 5:
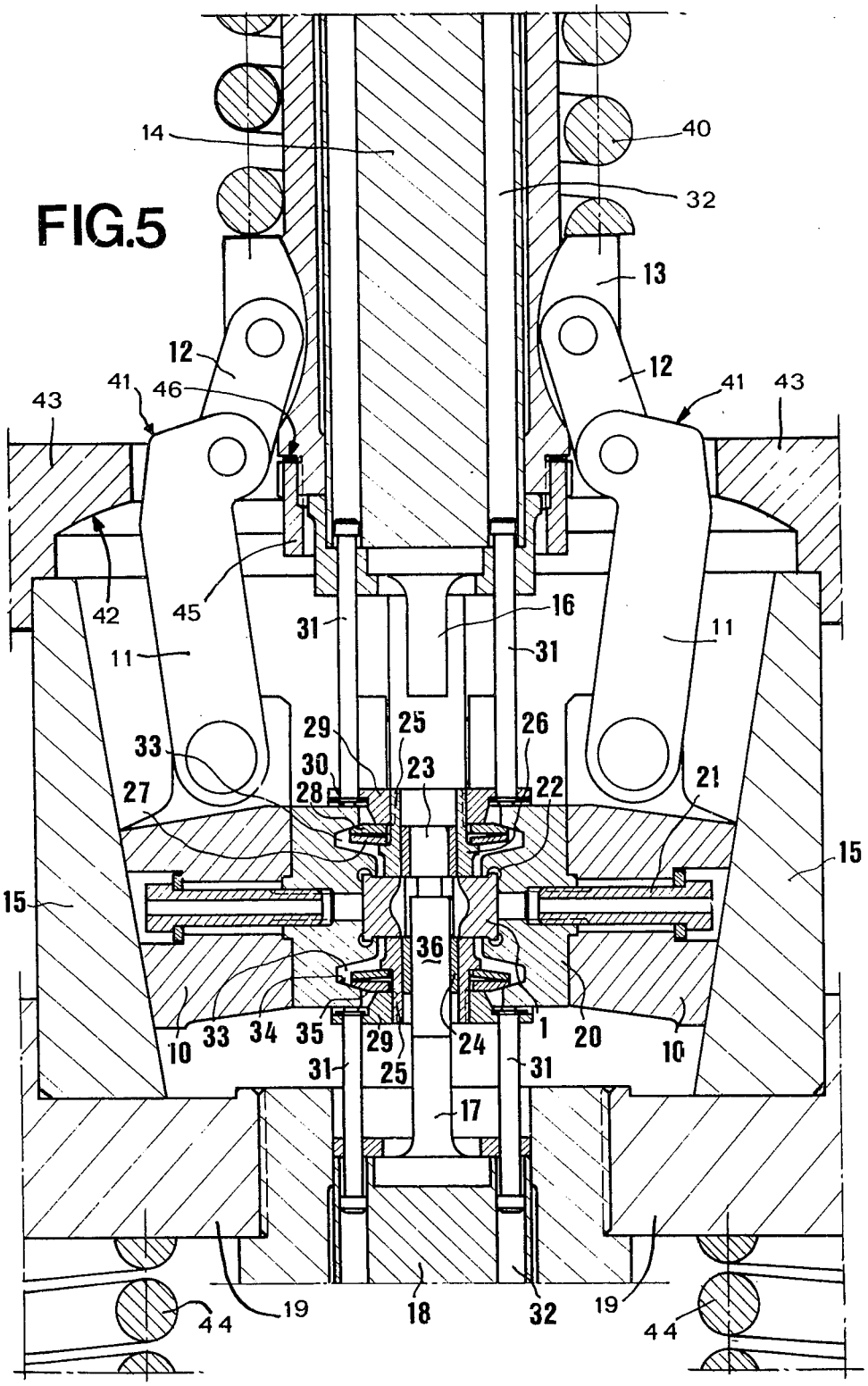
FIG. 5 is a longitudinal sectional view of a cold forming apparatus in its open position.

According, to one embodiment of the invention the cold forming apparatus as illustrated in its open position in FIG. 5 and constructed and arranged for forming the "spider" or cross piece of a universal joint, the apparatus comprising slide members 10 connected to the plunger 14 of a forming press through toggle linkages each comprising a locking link 11 and another link 12 pivotally connected to each other the locking link 11 being pivoted on the corresponding slide member or ram and the other link 12 pivoted on a sleeve 13 slidably mounted on the plunger 14. A compression spring 10 accommodated around the plunger 14 abuts at its upper end against a shoulder (not shown) of the plunger, the compression spring 10 bearing at its lower end against the upper edge of a ring 13 so as to urge it downwards. The slide members or rams 10 are displaceable along inclined, slotted slideways 15 which converge downwards toward the axis of the coaxial upper and lower punches 16 and 17 fixed respectively to the plunger 14 of the press and to a column 18 mounted on the table of the press (not shown). The slotted slideways 15 are supported on an annular plate member 19 adapted to slide along the column 18 and resting on a set of compression springs 44 carried by the table of the press, the spring force of the set of springs 44 being equal to that of the spring 40 interposed between the ring 13 and the shoulder on the plunger 14. The slideways 15 are retained radially at their lower end in a recess in the plate member 19 and at their upper end in a centering recess in an annular coller 43 which is connected to the annular plate member 19 by unshown tie rods. The annular collar 43 has a frustoconical bearing surface 42 facing downwards. The locking links 11 are provided with locking elbow 41 adapted to be forced against the bearing surface 42 of the annular collar 43 when the apparatus is locked. At the lower end of the sliding ring 13 is threaded a threaded adjustment ring 45, a shim 46 being disposed between the adjustment ring 45 and the shoulder on the sliding ring against which it abuts.

Die sector carriers 20 are secured by screws 21 to the rams 10, the die sector carriers being sector-shaped as the die sectors 1 and having on their inner face a T-slot 22 adapted to accommodate the outer ends of the die sectors 1 and retain them by their flanges 5 which constitute quick fastening and release means. This connection comprises a dovetail connection enabling rapid mounting and dismounting of the die sectors 1 whose outer end is merely slid in the T-slot which is part cylindrical to mate with a corresponding part cylindrical outer bearing surfaces 8 on die sectors. Above and below the die sectors 1 are provided upper and lower guide bushes 23 and 24 coaxial with the axis of coaxial punches 16 and 17, the guide bushes 23 and 24 being accommodated in hoop reinforcing members 25 which are generally cylindrical sleeves with a collar 26 and threaded at one end.

A Belleville washer 27 and a bearing ring 28 are stacked on the collar 26 of each hoop reinforcing member and are retained by a locating cap 29 centered and threaded on the screw threaded end of the corresponding reinforcing member 25. Each cap 29 has a flange provided with locating holes 30 receiving the ends of posts 31 serving to center the reinforcing members 25 and their associated guide bushes, the posts 31 being slidably mounted in deep bores 32 in the plunger 14 and in the column 18 supporting the punches 16 and 17. To each side of the T-slot 22 there is provided in each die sector carrier 20 a circular groove 33 of V-shape in cross section adapted to accomodate the outer periphery of the associated bearing ring 28 and the Belleville washer 27. The inclined flanks 34 of the V-shaped grooves 33 directed towards the die sectors 1 forming the frustoconical portions cooperating with the outwardly directed surfaces 35 of the bearing ring 28, the surfaces 35 being frustoconical surfaces congruent with those of the inclined flanks 34 of the V-shaped grooves 33.

The operation of the apparatus will now be described:

The apparatus is open (FIG. 5), i.e., the punck 16 being in its raised position and the toggle linkages made up of the locking links 11 and links 12 are straightened out, the rams 10 are in their raised position which keeps the die sector carriers 20 and the associated die sectors 1 apart and permits the positioning of a cylindrical metal billet or blank 36 which is introduced into the upper guide bush 23 and rests on the lower punch 17 while guided and held vertically by the lower guide bush 24.

In this rest position the bearing ring 28 bears along its peripheral area against the annular margin of the portions of the groove 33 formed in the die sector carriers 20 such that the bearing rings are at their maximum spaced position and the Belleville washers 27 are little, if at all, compressed and therefore the die sectors 1 are not clamped by the guide bushes 23 and 24 and their reinforcing members 25.

In order to cold form the metal billet or blank, the apparatus is closed by lowering the plunger 14 of the press which drives the rams 10 therewith, the rams following their inclined slideways 15 and come towards the common axis of the punches 16 and 17 until the die sectors 1 abut and drivingly bear against one another. Simultaneously, the inward radial approach of the die sector carriers 20 cause the frustoconical surfaces 35 of the bearing rings 28 along the inclined flanks 34 of the grooves 33 which brings about the displacement of the bearing rings 28 which slide on the reinforcing member 25 and move towards the die sectors while compressing the Belleville washers 27 which, bearing against the collars 26 on the hoop reinforcing members 25, urge the same forcefully against the die sectors.

At this precise moment the elbows 41 of the locking links 11 are level with the edge of the frustoconical bearing surface 42 and under the action of the plunger 14 transmited to the sliding ring 13 through the compressed spring 40, the toggle linkages flex and force the elbows 41 to engage under the annular collar 43, the preloading exerted against the die sectors increasing as a function of the displacement of the elbows 41 under the bearing surface 42 because the locking links 11 undergo a clamping action due to the off setting of the axis of rotation of the locking link and the center of curvature of the corresponding radial cross section of the bearing surface 42. The preloading force is limited by the abutment of the threaded adjustment ring 45 on the upper end of the rams 10; the magnitude of the preloading force may be varied by changing the shim 46.

Figure 6:
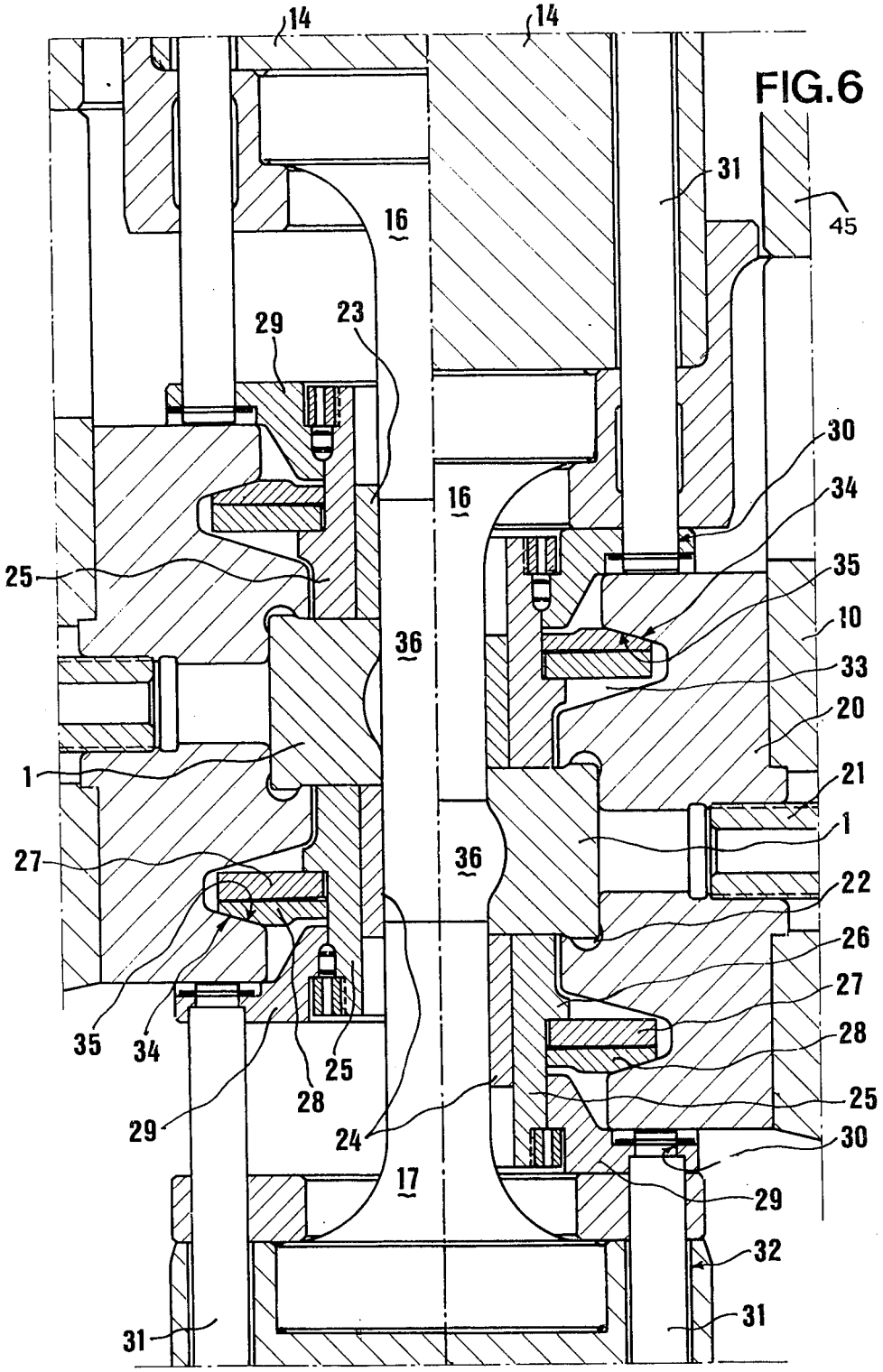
FIG. 6 is an enlarged view similar to that of FIG. 5 in which the cold forming apparatus is in the closed position of the die, before extrusion on the left and after extrusion on the right.

The position of the various parts just prior to actual forming is illustrated to the left of the dash-dotted line in FIG. 6; at this stage of the operation, the die is closed, radially preloaded and locked, and the upper and lower guide bushes 23 and 24 together with their reinforcing members 25 are forcefully urged axially against the die sectors 1 and the cylindrical metal billet or blank 36 is squeezed between the punches 16 and 17 and extends right through the die, guided by guide bushes 23 and 24 at its ends.

During the actual cold forming operation, the plunger 14 of the press continues its down stroke and the clamped, preloaded and effectively one-piece assembly formed by the annular plate member 19, the slotted slideways 15, the annular collar 43, the rams 10, the die sector carriers 20, the die sectors 1, the guide bushes 23 and 24, the reinforcing members 25 and the caps 29 move downwardly at half the speed of the plunger 14 owing to the fact that the spring force of spring 40 is equal to that of the set of springs 44 so that the upper and lower punches 16 and 17 penetrate symmetrically at first into the guide bushes 23 and 24 which contain the billet or blank metal and channel its plastic flow towards the central cavity of the die, the punches driving, in an identical manner, the billet or blank metal into the radial cavities in the die sectors, whereby the metal flows through the die throats 4 provided at the entrances to the radial cavities.

It will be noted that the billet or blank metal cannot flow between the interfaces of the guide bushes 23, 24 and the die sectors 1 because the guide bushes and their reinforcing members 25 are forcefully pressed against the die by axial friction force produced along the bores of the bushes by the flow of highly compressed billet metal, these friction forces reaching 20 to 50 metric tons.

When the punches 16 and 17 have attained their minimum distance apart, equivalent to the desired height of the part to be formed, the extrusion of the billet metal is finished, as shown to the left in FIG. 6, the plunger 14 moves upwards and with it, at half the speed, the entire unitary assembly detailed above, the apparatus returning to its FIG. 5 position.

When the die sectors become worn or damaged and require replacement, it is sufficient to displace them angularly about the central axis to release their annular flanges 5 from the arcuate T-slot 22 in the die sector carriers 20, the dovetail joint enables a quick and easy replacement of the die sectors when the axial preloading due to the Belleville washers is relaxed and when the die sector carriers 20 are sufficiently circumferentially moved apart to permit lateral drawing out.

With the present apparatus and thanks to the structure and arrangement of the parts thereof, the following advantages are obtained:

1. the die sectors, i.e. the forming tools, are of very small size and therefore have a production cost which is much less than with prior types in which the size of the die sectors was equal to that of the parts 1, 20, 23, 24 and 25 taken together. The die sectors are easily and quickly replaced.

2. The radial thrust necessary to provide the circumferential preloading of the die sectors against one another is reduced by a factor of about 3, hence the mechanism may be much lighter, simpler of design and less expensive.

3. The small size of the die sectors permits practical fabrication of such parts by cold forming or electroerosion, as well as making profitable use of very high strength but expensive materials, such as tungsten and cobalt carbides, which confer, particularly for cold extrusion of steels, considerable service life on the die sectors.

The scope of the invention is of course not limited to the illustrated and described embodiment given by way of example but it covers all modifications and variations within the appended claims.

For example, the die sectors can be brought together by other means than toggle linkages, slide members and inclined slideways and other locking means can also be used.

What is claimed is:

1. Apparatus for cold forming cylindrical metal blanks into parts having a central body and radial extensions, said apparatus comprising a die having plural die sectors arranged when brought together to define a chamber of the shape of the part to be formed, means for bringing said die sectors together, punches operable to penetrate through opposed entrances evenly into a central through cavity of shape corresponding to the central body of the part to be formed, said punches being adapted to drive blank metal from said central cavity towards radial cavities of shape corresponding to the radial extensions of the part to be formed; wherein the improvement comprises:

a. said die sectors being of shortened axial height in their radial forming and extrusion zone:

b. die carrier members for carrying said die sectors, and quick fastening and release means for fastening said die sectors to their associated die carrier members;

c. guide bushes being disposed at the entrances to said central cavity and coaxial with said punches, said guide bushes being adapted to restrain compressed blank metal radially and channel its plastic flow towards said central cavity, and means for forcefully urging said guide bushes against said dies sectors when said die sectors are brought together.

2. Apparatus according to claim 1, wherein said quick fastening and release means comprises a dovetail connection between each said die sector and its associated die carrier

3. Apparatus according to claim 1, wherein said guide bushes have hoop reinforcing members.

4. Apparatus according to claim 1, wherein said means for urging said guide bushes against said die sectors comprise a member having convex frustoconical surface resiliently connected to said guide bushes and a complementary concave frustoconical surface on said die carrier members, said frustoconical surfaces coacting as said die sectors are brought together to urge said bushes resiliently against said die sectors.

* * * * *